US005415566A

United States Patent [19]

Brunker et al.

[11] Patent Number: 5,415,566

[45] Date of Patent: May 16, 1995

[54] SHIELDED ELECTRICAL CONNECTOR ASSEMBLY

[75] Inventors: David L. Brunker, Naperville, Ill.; Helen Dechelette, Wissous, France

[73] Assignee: Molex Incorporated, Lisle, Ill.

[21] Appl. No.: 242,486

[22] Filed: May 13, 1994

[30] Foreign Application Priority Data

May 14, 1993 [EP] European Pat. Off. ..... 93107860

[51] Int. Cl.[6] ..... H01R 13/648

[52] U.S. Cl. ..... 439/608; 439/701

[58] Field of Search ..... 439/63, 578, 581, 607–610, 439/701, 92, 101, 108

[56] References Cited

U.S. PATENT DOCUMENTS

| | | | |
|---|---|---|---|
| 4,451,107 | 5/1984 | Dola et al. . | |
| 4,861,271 | 8/1989 | Bogar et al. | 439/63 |
| 5,009,616 | 4/1991 | Fogg et al. | 439/608 |
| 5,046,952 | 9/1991 | Cohen et al. | 439/63 |
| 5,133,679 | 7/1992 | Fusselman et al. | 439/608 |
| 5,141,453 | 8/1992 | Fuselman et al. | 439/608 |
| 5,228,871 | 7/1993 | Goodman | 439/607 |

*Primary Examiner*—Khiem Nguyen
*Attorney, Agent, or Firm*—A. A. Tirva

[57] ABSTRACT

A shielded electrical connector assembly includes a conductive housing having receptacle means for receiving a complementary mating connector. A terminal module includes a dielectric terminal block mounted in the conductive housing at the receptacle. The terminal block mounts a plurality of spaced terminals having contact portions projecting into the receptacle and adapted for electrical interconnection with appropriate contacts of the complementary mating connector. The terminal block has openings between the spaced terminals. The conductive housing includes integral shield portions projecting into the openings in the terminal block between the spaced terminals. The housing also includes integral ground portions in the receptacle and adapted for interconnection with appropriate ground contacts of the mating connector.

16 Claims, 6 Drawing Sheets

SHIELDED ELECTRICAL CONNECTOR ASSEMBLY

FIELD OF THE INVENTION

This invention generally relates to the art of electrical connectors and, particularly, to a shielding and grounding electrical connector assembly, such as for use with coaxial cables.

BACKGROUND OF THE INVENTION

Shielded coaxial cables have a conductor core with a sheath of insulation therearound, an outer insulating jacket and a shield means, such as a braid or foil, between the sheath and the jacket. Coaxial cables of the character described are becoming increasingly miniaturized and commonly are termed "microcoaxial" cables and are used for high speed signal applications.

In order to avoid having to prepare the cables, such as exposing the braided or foil shield means in conventional crimping or soldering termination techniques, axially terminating connector systems have been designed, particularly for microcoaxial cables. In particular, signal terminals have been employed within improved connector assemblies such that the signal terminals have at least one deflectable wall portion for displacing the insulating sheath of the cable to terminate the core upon application of a force directed generally parallel to the longitudinal axis of the cable. U.S. Pat. No. 5,116,230 to Dechelette et al, dated May 26, 1992 and assigned to the assignee of this invention, shows a further improved connector assembly for terminating a shielded coaxial cable, in which a conductive grounding terminal means includes piercing means for displacing the outer insulating jacket of the cable upon application of a force on the grounding terminal means generally parallel to the longitudinal axis of the cable. Therefore, the cable can be both grounded and terminated in response to application of axial forces by very simple application tooling.

Coaxial cable connector assemblies of the character described immediately above often are mated with electrical connector assemblies mounted to printed circuit boards, particularly a header-type connector having mating signal terminal pins, along with grounding terminal pins engageable with the conductive grounding terminal means of the coaxial cable connector. This invention is directed to providing a connector assembly, such as a header connector assembly, for mating with a coaxial cable connector assembly, the header connector assembly including novel shielding means and grounding means.

SUMMARY OF THE INVENTION

An object, therefore, of the invention is to provide a new and improved shielded electrical connector assembly and, particularly, such an assembly which is readily applicable for mating with a coaxial cable connector assembly.

In the exemplary embodiment of the invention, the shielded electrical connector assembly includes a conductive housing having receptacle means for receiving a complementary mating connector, such as a coaxial cable connector as described above. A terminal module includes a dielectric terminal block mounted in the conductive housing at the receptacle means. The terminal block mounts a plurality of spaced terminals having contact portions projecting into the receptacle means of the housing and adapted for electrical interconnection with appropriate contact means of the complementary mating connector.

According to one aspect of the invention, the terminal block includes openings between the spaced terminals. The conductive housing includes shield portions projecting into the openings in the terminal block between the spaced terminals.

In the preferred embodiment of the invention, the conductive housing is provided as a die cast component. The shield portions are provided as integral plate-like portions of the die cast housing. As disclosed herein, the contact portions of the terminals are provided as terminal pins, and the terminals include tail portions projecting outwardly of the housing for interconnection to appropriate circuit traces on a printed circuit board. The connector assembly may be a right-angled connector with the tail portions of the terminals being bent at generally right angles alongside the housing for interconnection to the circuit traces on the printed circuit board. With the right-angled connector, a shielding plate is mounted to the housing over the tail portions of the terminals.

According to another aspect of the invention, the conductive housing includes integral ground portions in the receptacle means and adapted for interconnection with appropriate ground contact means of the complementary mating connector. In the preferred embodiment of the invention, the ground portions are provided by integral ribs on the inside of the die cast housing and adapted to slide into appropriate grooves in the complementary mating connector for engaging the ground contact means thereof. These integral grounding ribs on the die cast housing completely eliminate the separate grounding pins of the prior art.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
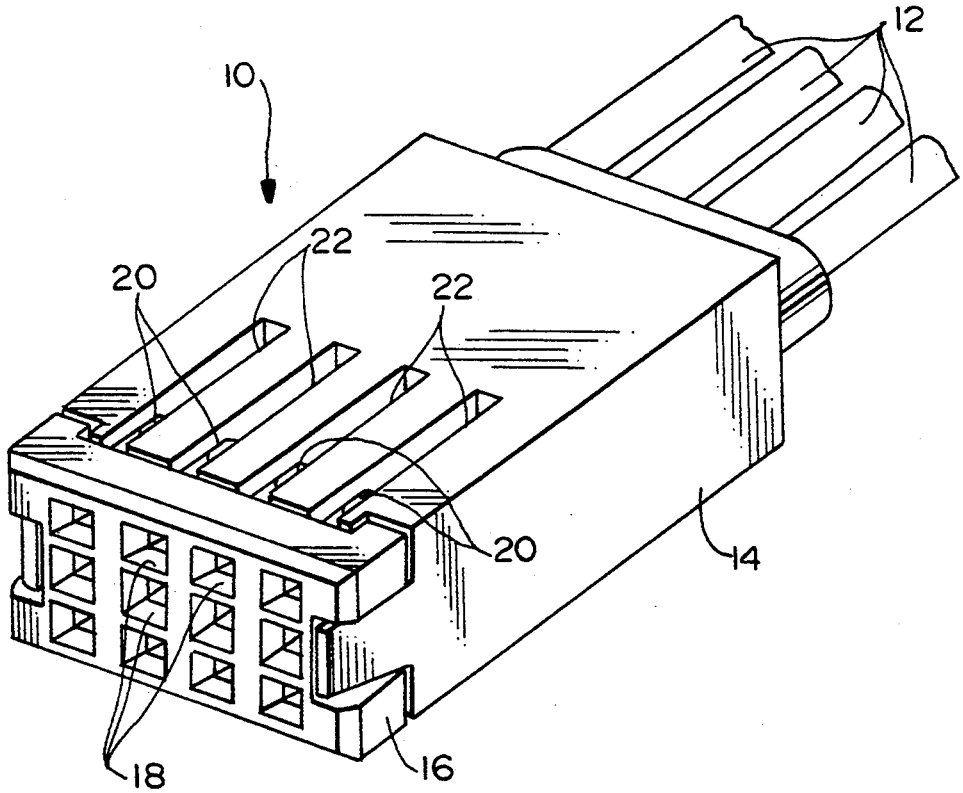
FIG.1 (PRIOR ART)
FIG. 1 is a perspective view of a coaxial cable connector assembly according to the prior art.

Referring to the drawings in greater detail, FIG. 1 shows a coaxial cable connector assembly, generally designated 10, of the prior art as shown in U.S. Pat. No. 5,116,230 described above and which is incorporated herein by reference. The details of connector 10 will not be dealt with herein. However, suffice it to say, the connector is designed for electrically terminating and groundingly terminating a plurality of insulated wires or microcoaxial cables 12. The connector includes an outer housing or shield 14 and a lower mating connector entry cap 16. The entry cap has three rows of four entry openings 18 which are in communication with respective terminal-receiving passages within housing 14 for mounting a plurality of terminals terminated to respective ones of cables 12. The connector also includes grounding terminal means within housing 14 and which includes grounding contact means 20 exposed in grooves 22 in opposite sides of housing 14. When connector 10 is mated with a header connector as shown in the aforementioned patent, the header connector includes a plurality of signal pins insertable through openings 18 into mating interconnection with the signal terminals within the housing terminated to coaxial cables 12. In addition, the mating header connector also includes separate grounding pins which are inserted into grooves 22 on the outside of connector 10 for engagement with grounding contact means 20.

Figure 2:
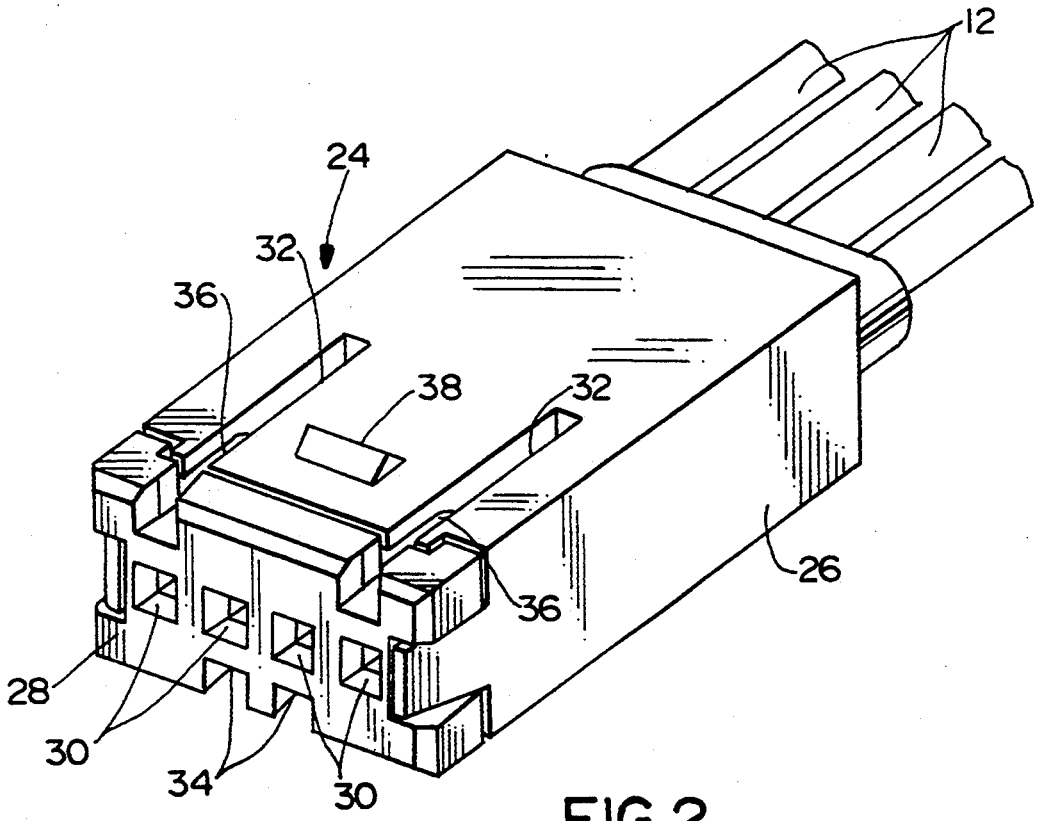
FIG. 2 is a perspective view of a coaxial cable connector assembly as would be used with the shielded electrical connector assembly of the invention.

FIG. 2 shows another coaxial cable connector, generally designated 24, which is designed for terminating a plurality of microcoaxial cables 12. The connector includes an outer housing or shield 26 and a lower entry cap 28 similar to connector 10 in FIG. 1. However, connector 24 in FIG. 2 includes four entry openings 30 in entry cap 28 for receiving four signal pins, along with two grooves 32 at the top of the connector and two grooves 34 at the bottom of the connector and having grounding contact means 36 exposed therein. It can be seen that grooves 32 at the top of the connector are spaced-apart more than grooves 34 at the bottom of the connector for polarizing purposes. A latch boss 38 is formed on at least the top of the connector housing 26. Coaxial cable connector assembly 24 is designed as a complementary mating connector for use with the shielded electrical connector assembly of the invention, as described below.

Figure 3:
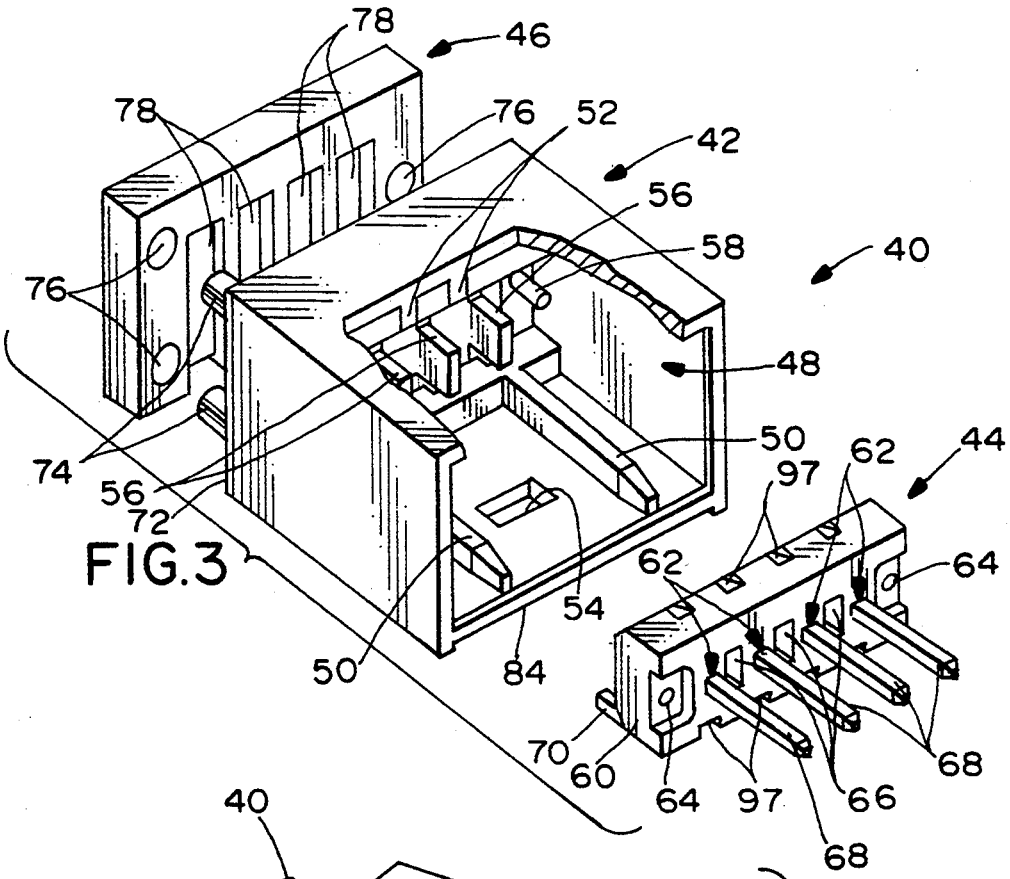
FIG. 3 is an exploded perspective view of the connector assembly of the invention.

More particularly, FIG. 3 shows the different components of a shielded electrical connector assembly, generally designated 40, embodying the concepts of the invention. Connector assembly 40 is designed as a header adapted for mounting to a printed circuit board, as described hereinafter. Generally, header 40 includes a conductive housing, generally designated 42, and a terminal module, generally designated 44, along with a rear shielding plate, generally designated 46. The shielding plate is used only when the header is designed as a right-angled connector assembly, again as described hereinafter.

Conductive housing 42 is a one-piece die cast housing of typically metallic material which resists soldering temperatures, such as a zinc alloy material although alternate conductive materials such as loaded, conductive plastics employing press-fit grounding and support pegs could be considered. The housing is generally hollow to define receptacle means, as at 48, for receiving complementary mating connector 24 (FIG. 2). The housing includes integral grounding ribs 50 which slide into grooves 32 of the mating connector for engaging the grounding contact means 32 within the grooves, as well as integral grounding ribs 52 for sliding into grooves 34 for electrically engaging the grounding contact means therein. Therefore, the wider spaced ribs 50 and grooves 32, along with narrower spaced ribs 52 and grooves 34 provide complementary interengaging polarizing means between mating connector 24 and header 40. The housing also includes a latching hole 54 for latching interengagement with latch boss 38 (FIG. 2) of the mating connector. Lastly, as clearly seen in FIG. 3, integral plate-like shield portions 56 project into receptacle means 48 of housing 42, along with a pair of fastening posts 58 for purposes to be described below.

Still referring to FIG. 3, terminal module 44 includes a dielectric terminal block 60 of molded plastic material, the terminal block mounting a plurality of four spaced terminals, generally designated 62. The terminal block is sized and shaped to be adapted for positioning within housing 42 at the front of receptacle means 48 such that fastening posts 58 project into a pair of fastening holes 64 in the terminal block, and plate-like shield portions 56 project into a plurality of three openings 66 through the terminal block. Fastening posts 58 can be staked to lock terminal module 44 within housing 42. Plate-like shield portions 56 of the housing, projecting into openings 66 of the terminal block, provide shielding between each adjacent pair of terminals 62. The width of portions 56 may be less than the width of openings 66 whereby air gaps are created to improve the dielectric coefficient and thus to improve the shielding. There is interference in the height direction between portions 56 and openings 66 to achieve mechanical retention of block 60 in housing 42. As seen in greater detail hereinafter, each terminal 62 includes a contact portion in the form of a terminal pin 68 projecting forwardly into receptacle means 48 of housing 42, along with a tail portion 70 projecting rearwardly of the terminal block.

Shielding plate 46 is a conductive plate which can be soldered to a rear face 72 of housing 42, or a plurality of fastening posts 74 can project from the rear of the housing into respective holes 76 in the shielding plate. The fastening posts can be staked to secure the shielding plate to the rear of the housing. As seen in FIG. 3, the shielding plate has a plurality of four recesses 78 which will form interior cavities when the shielding plate is secured to the rear of the housing. The cavities accommodate tail portions 70 of the terminals, as will be seen hereinafter.

Figure 4:
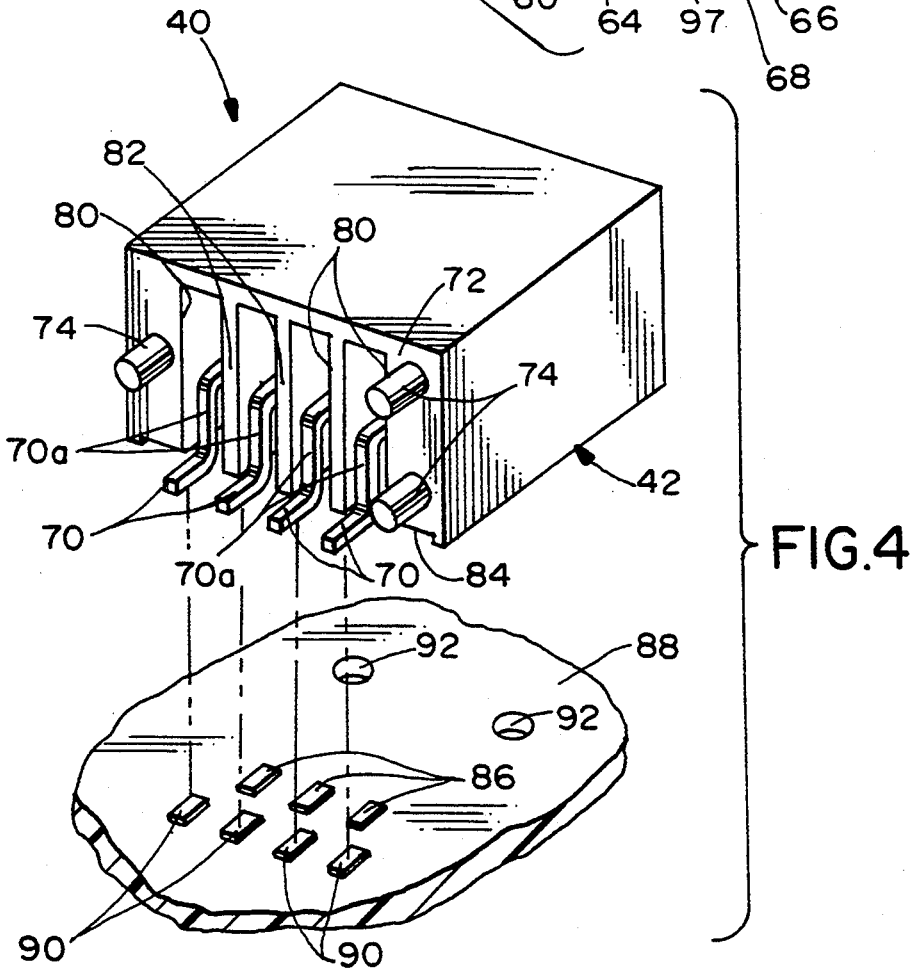
FIG. 4 is a perspective view of the rear end of the connector assembly, with the shielding plate removed to facilitate the illustration, and in conjunction with a portion of a printed circuit board.

FIG. 4 shows header 40 in assembled condition, except for shielding plate 46, and illustrates how tail portions 70 of the terminals project from rear face 72 of housing 42, with right-angled bent portions 70*a* of the terminals being located alongside of the housing within slots 80. In comparing FIG. 4 with FIG. 3, plate-like shield portions 56 (FIG. 3) actually are forwardly projecting portions of three plate-like shielding partitions 82 at the rear of housing 42 between each adjacent pair of the terminals, again to completely shield one terminal from the other. Partitions 82 project downwardly from a bottom surface 84 of housing 42 to a point for engagement with three solder pads 86 on a printed circuit board 88 (FIG. 4), the solder pads being part of a ground circuit on the printed circuit board. Tails 70 of the terminals are adapted for soldering to four pads 90 on circuit board 88, solder pads 90 being portions of signal circuit traces on the board. Lastly, FIG. 4 also shows a pair of mounting holes 92 in printed circuit board 88 for receiving appropriate mounting pegs projecting from the underside of housing 42, as will be seen hereinafter. Therefore, FIG. 4 shows that the preferred embodiment of header 40 is a right-angled connector as shown.

Figure 5:
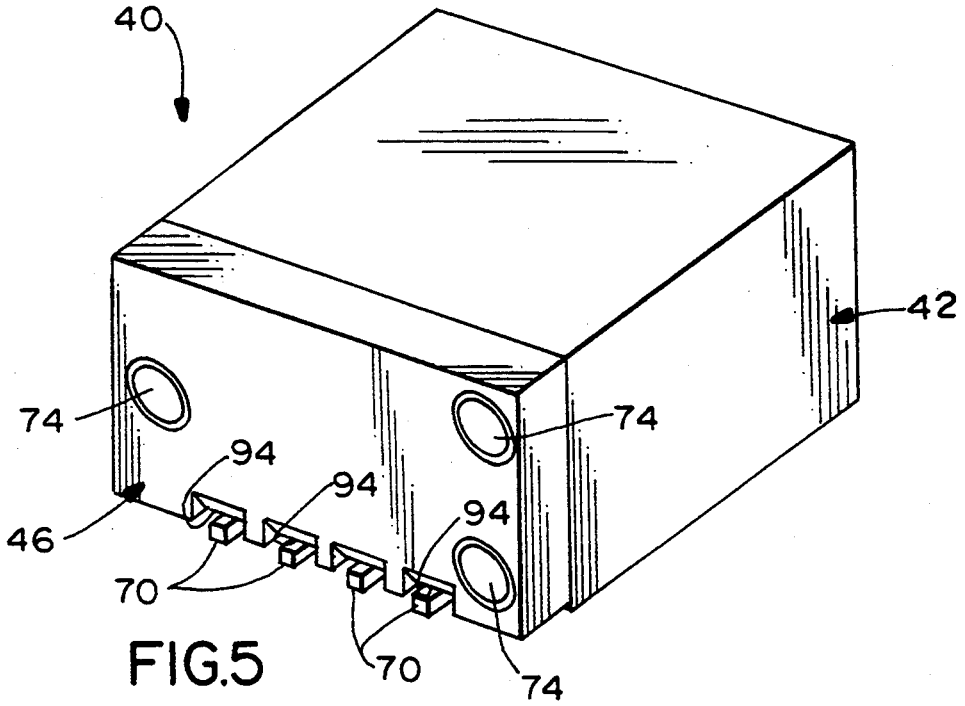
FIG. 5 is a perspective view of the rear of the connector assembly, such as shown in FIG. 4, but with the shielding plate mounted to the connector housing.

FIG. 5 shows the entire right-angled header 40 in assembled condition, with shielding plate 46 staked to rear face 72 of housing 42 by fastening posts 74. Tail portions 70 are visible in FIG. 5 within notches 94 in the bottom edge of shielding plate 46. Therefore, it can be seen that the terminals 62 are completely shielded from each other within the bounds of header 40, except for mating terminal pins 68 (FIG. 3).

Figure 6:
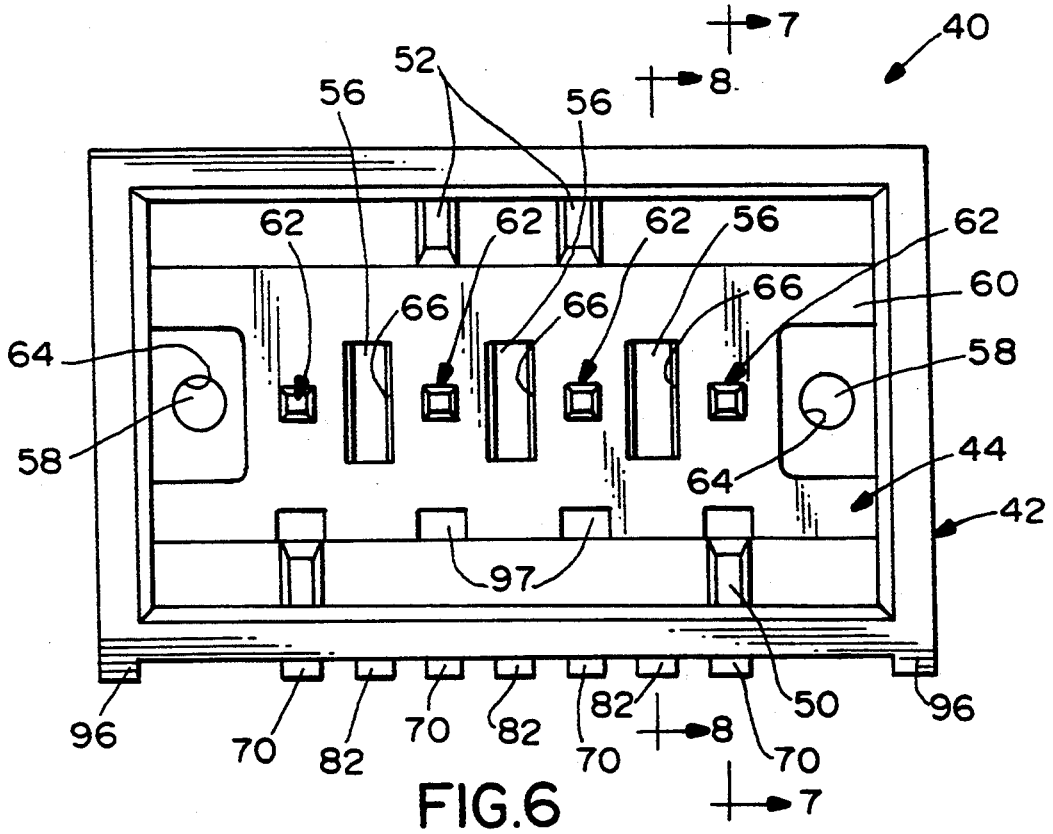
FIG. 6 is a front elevational view of the connector assembly.

FIG. 6 shows a front elevational view of the fully assembled header 40, with tail portions 70 of terminals 62 and the bottoms of partitions 82 being in a common plane for soldering to circuit traces on a printed circuit board, such as solder pads 90 and 86 of circuit board 88 in FIG. 4. FIG. 6 also shows that housing 42 has depending side flanges 96 providing stand-off means for the housing when mounted on the printed circuit board. Lastly, FIG. 6 clearly shows the differential in spacing between grounding ribs 50 at the bottom of the header and grounding ribs 52 at the top of the header, for polarizing purposes as described above.

Figure 7:
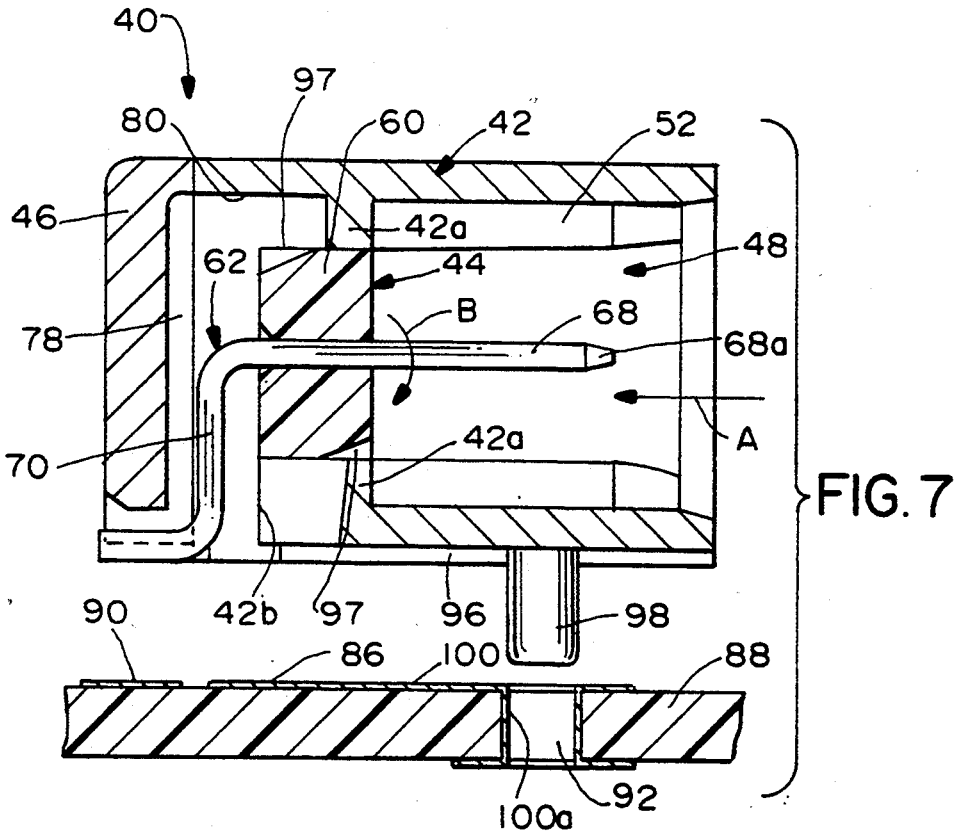
FIG. 7 is a vertical section taken generally along line 7—7 of FIG. 6.
Figure 8:
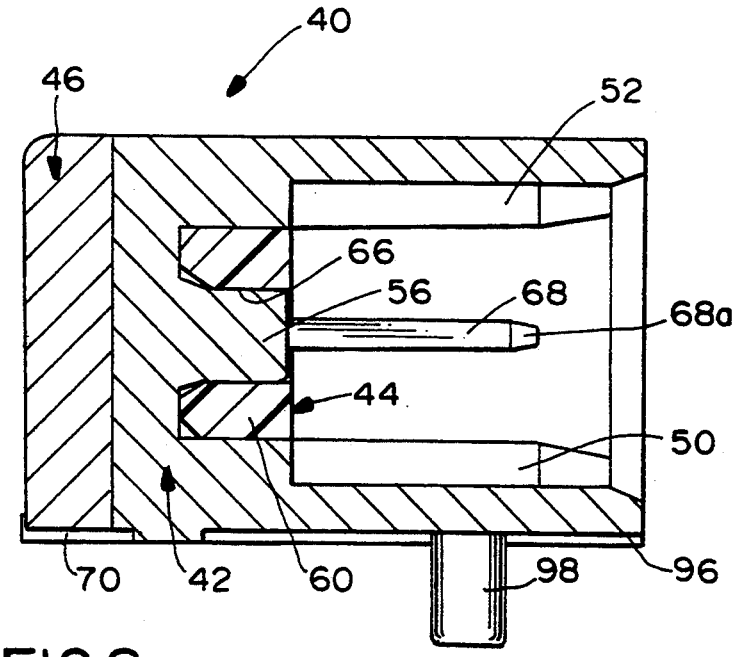
FIG. 8 is a vertical section taken generally along line 8—8 of FIG. 6.

FIGS. 7 and 8 clearly show how terminal pin portions 68 project forwardly into receptacle means 48 of housing 42, as well as how grounding ribs 50 and 52 also project forwardly in the receptacle means at the bottom and top thereof. It should be noted that the tips or contact portions 68*a* of terminal pins 68 may be plated, such as with gold, to enhance the electrical contact characteristics thereof.

FIG. 7 shows how terminal module 44 is mounted or assembled inside housing 42 between upper and lower interior wall portions or partitions 42*a* of the housing. Terminals 62 are mounted in terminal block 60, and then the terminal module is assembled into housing 42, through receptacle means 48 in the direction of arrow "A". However, because tail portions 70 of terminals 62 are bent at right angles as most clearly shown in FIG. 7, the entire terminal module must be tilted slightly in the direction of arrow "B" during assembly of the module into the housing in the direction of arrow "A". In addition, notches 97 are formed in opposite diagonal corners of terminal block 60 so that the block can bypass interior wall portions 42*a* of the housing until tail portions 70 clear the wall portions, whereupon the terminal module is tilted back to the position shown in FIG. 7 and staked into position. The module, when fully assembled, will abut against interior surfaces 42*b* of housing 42 between slots 80 at the rear of the housing.

Terminals 62 and terminal block 60 may be assembled several different ways. For example, the terminal block may be mounted into housing 42 and terminals 62 may be inserted from the rear. Terminal block 60 may be loaded with straight pins 62 and inserted through receptacle means 48 and the pins are formed after insertion. Additionally, tail portions 70 of the terminals 62 may be straight for insertion into apertures (not shown) in the printed circuit board 88.

FIG. 7 also shows that housing 42 may be provided with mounting pegs 98 which not only mechanically secure the header to printed circuit board 88 within mounting holes 92, but the mounting pegs can be used to further ground the entire assembly to a grounding circuit path 100 on the board, the ground path including solder pads 86. Specifically, it can be seen that the inside of mounting holes 92 are plated, as at 100*a*, with conductive material as part of ground path 100. Therefore, with housing 42 being of a die cast metal material, and with mounting pegs 98 being cast integrally therewith, the entire housing and its respective integral components can be grounded to a ground path on the printed circuit board.

Figure 9:
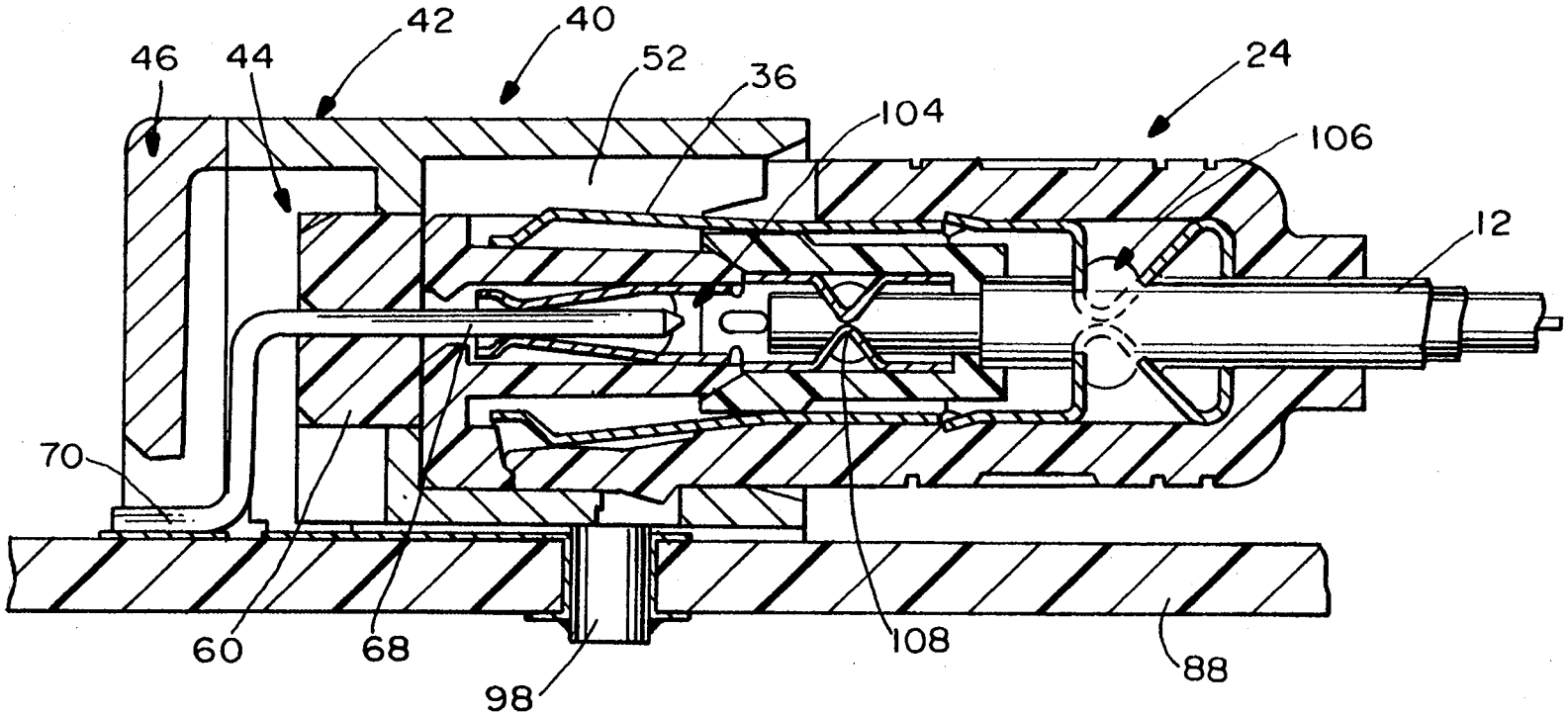
FIG. 9 is an axial section through the connector assembly, similar to that of FIG. 7, and with the assembly mated with the coaxial cable connector of Figure 2.

FIG. 9 shows coaxial cable connector 24 (FIG. 2) mated within header 40, and with the header completely terminated to printed circuit board 88. It can be seen how terminal pins 68 of the header project into the coaxial cable connector and into mating electrical interconnection with a plurality of signal terminals, generally designated 104, within the coaxial cable connector assembly. One of the grounding ribs 52 of conductive, die cast housing 42 also is seen clearly in engagement with grounding contact means 36 of the coaxial cable connector assembly. The grounding contact means is terminated to the braid or foil of coaxial cable 12, as at 106. Each signal terminal 104 is terminated to the conductive core of the cable, as at 108. Of course, other details of coaxial cable connector assembly 24 can be derived by reference to the aforementioned U.S. Pat, No. 5,116,230. It can be seen in FIG. 9 how integral grounding ribs 52 (or ribs 50) completely eliminate the need for separate grounding terminals or pins within the header for engaging grounding contact means 36.

Figure 10:
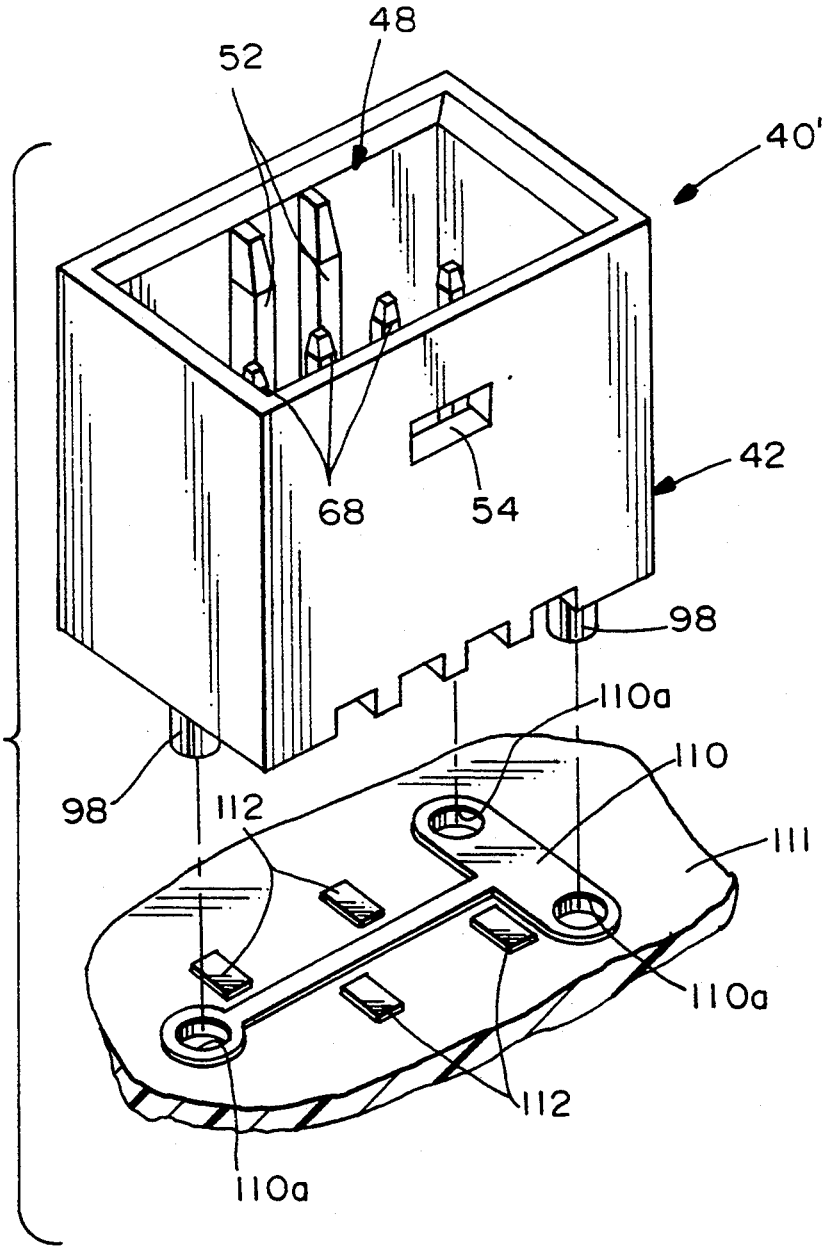
FIG. 10 is a perspective view of an alternate embodiment of the invention wherein the connector assembly is used as a "straight" connector versus the right-angled connector of FIGS. 3–9.

Lastly, FIG. 10 shows an alternate embodiment of a header, generally designated 40', which has a conductive, die cast housing 42 identical to housing 42 of header 40 (FIG. 3). The housing also includes receptacle means 48 for receiving complementary mating coaxial connector assembly 24. The difference between header 40' (FIG. 10) and header 40 (FIGS. 3–9) is that header 40' is shown in Figure 10 as being a "straight" connector versus right-angled header 40. It can be seen that shielding plate 46 (FIG. 3) is omitted and is not necessary in the application of the invention in FIG. 10. In essence, housing 42 is grounded to a ground path 110 on a printed circuit board 111 by means of mounting pegs 98 projecting into holes 110*a* of the ground path. The mounting pegs 98 are positioned to provide polarization for the header. Although not visible in FIG. 10, the terminals of header 40' simply would have tail portions adapted for engagement with solder pads 112 of circuit board 111 which are part of signal circuit traces on the board. Shielding of the terminals by integral portions of housing 42 still would be the same as with header 40, and housing 42 would be grounded to the mating coaxial cable connector assembly by grounding ribs 50 and 52, ribs 52 being visible in FIG. 10.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claims:

1. A shielded electrical connector assembly, comprising:

a conductive housing including receptacle means at a front surface for receiving a complementary mating connector;

a terminal module including a dielectric terminal block mounted in the conductive housing from said front surface at said receptacle means, the terminal block mounting a plurality of spaced terminals having contact portions projecting into said receptacle means and adapted for electrical interconnection with appropriate contact means of the complementary mating connector, and the terminal block including openings between the spaced terminals; and said conductive housing including shield portions projecting into the openings in the terminal block between the spaced terminals.

2. The shielded electrical connector assembly of claim 1 wherein said conductive housing comprises a die cast component.

3. The shielded electrical connector assembly of claim 2 wherein said shield portions comprise integral die cast portions of the housing.

4. The shielded electrical connector assembly of claim 3 wherein said shield portions comprise plate-like members.

5. The shielded electrical connector assembly of claim 1 wherein said contact portions of the terminals comprise terminal pins.

6. The shielded electrical connector assembly of claim 1 wherein said terminals include tail portions projecting outwardly of the housing for interconnection to appropriate circuit traces on a printed circuit board.

7. The shielded electrical connector assembly of claim 1 wherein said conductive housing includes ground portions in the receptacle means and adapted for interconnection with appropriate ground contact means of the complementary mating connector.

8. The shielded electrical connector assembly of claim 7 wherein said ground portions include ribs on the inside of the housing adapted to slide into appropriate recess means in the complementary mating connector.

9. The shielded electrical connector assembly of claim 1 wherein said shield portions comprise integral plate-like portions of the housing.

10. The shielded electrical connector assembly of claim 1 wherein the connector assembly is a right-angled connector with the terminals having tail portions projecting outwardly of the housing and at generally right angles alongside the housing for interconnection to appropriate circuit traces on a printed circuit board, and including a shielding plate mounted to the housing over the tail portions of the terminals.

11. A shielded electrical connector assembly, comprising:

a conductive die cast housing including receptacle means at a front surface for receiving a complementary mating connector;

a terminal module including a dielectric terminal block mounted in the housing from said front surface at said receptacle means, the terminal block mounting a plurality of spaced terminals having terminal pins projecting into the receptacle means and adapted for electrical interconnection with appropriate contact means of the complementary mating connector, the terminals including tail portions projecting outwardly of the housing for interconnection to appropriate circuit traces on a printed circuit board, and the terminal block including openings between the spaced terminals; and said conductive housing including integral plate-like die cast portions projecting into the openings in the terminal block between the spaced terminals for electrically shielding the terminals from each other.

12. The shielded electrical connector assembly of claim 11 wherein said conductive housing includes integral die cast ground portions in the receptacle means and adapted for interconnection with appropriate ground contact means of the complementary mating connector.

13. The shielded electrical connector assembly of claim 12 wherein said ground portions include ribs on the inside of the housing adapted to slide into appropriate recess means in the complementary mating connector.

14. A shielded electrical connector assembly, comprising:

a conductive housing including receptacle means at a front surface for receiving a complementary mating connector;

a terminal module including a dielectric means mounted in the conductive housing from said front surface and mounting a plurality of terminals having contact portions in the receptacle means adapted for electrical interconnection with appropriate contact means of the complementary mating connector; and said conductive housing including ground portions in the receptacle means and adapted for interconnection with appropriate ground contact means of the complementary mating connector.

15. The shielded electrical connector assembly of claim 14 wherein said conductive housing comprises a die cast component and said ground portions comprise integral die cast portions of the housing.

16. The shielded electrical connector assembly of claim 15 wherein said ground portions include ribs on the inside of the housing adapted to slide into appropriate recess means in the complementary mating connector.

* * * * *